US006371837B1

(12) United States Patent
Luedeke

(10) Patent No.: US 6,371,837 B1
(45) Date of Patent: Apr. 16, 2002

(54) METHOD OF REFINING A SURFACE

(75) Inventor: Arthur P. Luedeke, Marine on St. Croix, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/705,086

(22) Filed: Nov. 2, 2000

Related U.S. Application Data

(62) Division of application No. 08/966,643, filed on Nov. 10, 1997, now Pat. No. 6,142,858.

(51) Int. Cl.[7] ..... B24B 1/00

(52) U.S. Cl. ..... 451/57; 451/58; 451/342; 451/514

(58) Field of Search ..... 83/651; 451/57, 451/58, 59, 342, 360, 514, 538, 548

(56) References Cited

U.S. PATENT DOCUMENTS

| | | | |
|---|---|---|---|
| 1,587,843 | A | 6/1926 | Koreneff |
| 2,671,994 | A | 3/1954 | Hickman |
| 2,764,853 | A | 10/1956 | Rhees |
| 2,800,752 | A | 7/1957 | Short |
| 3,154,894 | A | 11/1964 | Dawkins |
| 3,157,010 | A | 11/1964 | Block |
| 3,210,892 | A | 10/1965 | Perham |
| 3,270,467 | A | 9/1966 | Block et al. |
| 3,315,420 | A | 4/1967 | Moberg |
| 3,362,114 | A | 1/1968 | Hurst |
| 3,376,675 | A | 4/1968 | Hutchins |
| RE26,552 | E | 3/1969 | Block et al. |
| 3,460,292 | A | 8/1969 | Ferchland |
| 3,526,065 | A | 9/1970 | Lee |
| 3,562,968 | A | 2/1971 | Johnson et al. |
| 3,579,917 | A | 5/1971 | Boettcher et al. |
| 3,603,042 | A | 9/1971 | Boettcher |
| 3,667,169 | A | 6/1972 | Mackay, Jr. |
| 3,688,453 | A | 9/1972 | Legacy et al. |
| 3,739,535 | A | 6/1973 | Fournier |
| 3,747,286 | A | 7/1973 | Haigh |
| 3,858,368 | A | 1/1975 | Cocherell et al. |
| 4,015,371 | A | 4/1977 | Grayston |

(List continued on next page.)

FOREIGN PATENT DOCUMENTS

| | | |
|---|---|---|
| EP | 0 397 624 A3 | 11/1990 |
| EP | 0 397 624 A2 | 11/1990 |
| WO | WO 96/33638 | 10/1996 |
| WO | WO 96/33841 | 10/1996 |

OTHER PUBLICATIONS

Product Sheets (3 pages) "Blue–Point" ¼", ⅜" and ½" Drive Air Ratches; ¾", 1" and Spline Drive Air Impact Wrenches; and Power Tools ¼", ⅜" and ½" Drive Air Impact Wrenches.
Brochure, Bal Seal Catalog No. 3.1E, Canted Coil Springs (12 pages), by Bal Seal Engineering Company, Inc., Santa Ana California.

*Primary Examiner*—Timothy V. Eley
(74) *Attorney, Agent, or Firm*—Gregory D. Allen

(57) ABSTRACT

A backup pad for engaging and supporting abrasive sheets, the backup pad being mounted securely to a drive shaft to prevent relative rotation thereto, and to allow easy mounting and dismounting of the backup pad to the mounting shaft without the use of tools. The backup pad includes a body comprising a front surface and a back surface, releasable engagement means provided on the front surface for releasably engaging an abrasive article, and a mounting boss provided on said rear surface. The mounting boss includes a first end facing away from the body, and an opening in the first end of the boss, the opening being formed by an inner surface generally perpendicular to said body and defining a non-circular cross-section. The opening includes elastic means such as an o-ring for releasably engaging a drive shaft mounted in said opening. Also disclosed is a method of using such a backup pad.

6 Claims, 3 Drawing Sheets

U.S. PATENT DOCUMENTS 4,311,489 A 1/1982 Kressner
4,517,863 A 5/1985 Ishikawa
4,541,205 A 9/1985 Patrello
4,605,154 A 8/1986 Hermann et al.
4,652,275 A 3/1987 Bloecher et al.
4,765,096 A 8/1988 Lang
4,799,939 A 1/1989 Bloecher et al.
4,932,163 A 6/1990 Chilton et al.
4,944,638 A 7/1990 Brohammer
5,088,241 A 2/1992 Lubbering et al.
5,152,631 A 10/1992 Bauer
5,207,028 A 5/1993 Timmons
5,226,682 A 7/1993 Marrison et al.
5,309,682 A 5/1994 Gutknecht et al.
5,423,717 A 6/1995 Boaz ..... 451/449
5,443,413 A 8/1995 Pflager et al. ..... 451/11
5,443,906 A 8/1995 Pihl et al. ..... 428/370
5,468,176 A 11/1995 Udert et al. ..... 451/359
5,478,271 A * 12/1995 Thibaut ..... 451/342
5,505,747 A 4/1996 Chesley et al. ..... 51/297
5,531,635 A 7/1996 Mogi et al. ..... 451/72
5,611,724 A 3/1997 DeGraaff ..... 451/53
5,639,273 A 6/1997 Sjolander et al. ..... 451/450
5,679,067 A 10/1997 Johnson et al. ..... 451/527
5,692,949 A * 12/1997 Sheffield et al. ..... 451/538
5,727,821 A 3/1998 Miller ..... 451/450
5,816,625 A 10/1998 Clark
6,247,999 B1 * 6/2001 Tokiwa ..... 451/8

* cited by examiner

METHOD OF REFINING A SURFACE

This is a divisional of Application Ser. No. 08/966,643 filed Nov. 10, 1997 now U.S. Pat. No 6,142,858.

TECHNICAL FIELD

The present invention relates generally to backup pads for use with abrasive articles, and more particularly to backup pads having a quick-release mechanism.

BACKGROUND OF THE INVENTION

It has long been known to use a backup pad to support abrasive articles, such as abrasive sheets which may be converted into any form, such as circular discs. The backup pad may be a hand-held pad for manual operation, or a backup pad for use with a power tool, such as a rotary or orbital sander. When the backup pad is for use on a rotary power tool, it is necessary to mount the backup pad to the rotary tool in a secure manner to prevent relative rotation between the backup pad and the power tool drive shaft. Typically, the backup pad is bolted to or is threaded engagement with the drive shaft on the power tool. (See for example, U.S. Pat. No. 3,562,968.) Other arrangements for securing the backup pad to the drive shaft of the rotary tool have also been used. (See for example, U.S. Pat. No. 3,270,467.)

However, it is seen that there exists a need for a backup pad that can be mounted securely to a drive shaft so as to prevent relative rotation between the two, and that may be easily released without the use of additional tools.

SUMMARY OF THE INVENTION

One aspect of the present invention presents a backup pad for releasably engaging an abrasive article. The backup pad comprises a body having a front surface and a back surface, releasable engagement means provided on the front surface for releasably engaging an abrasive article, and a mounting boss provided on the rear surface. The mounting boss includes a first end facing away from the body and an opening in the first end of the boss. The opening is formed by an inner surface generally perpendicular to the body and defining a non-circular cross section. The opening includes elastic means for releasably engaging a drive shaft mounted in the opening. The inner surface of the opening may a polygonal cross section, a regular polygonal cross section, or a hexagonal cross-section.

The elastic engaging means in the opening may comprise an elastic ring retained in a groove in the inner surface. The elastic ring may be, for example, an o-ring or a snap ring.

The releasable engagement means may comprise a vinyl surface adapted for releasable engagement with an adhesive layer on an abrasive article, a plurality of hooking stems adapted for releasable engagement with a loop material on an abrasive article, or a loop material adapted for releasable engagement with a plurality of hooking stems on an abrasive article.

The present invention also provides a quick release system for releasably attaching a backup pad on a mounting shaft. The system comprises a backup pad and a mounting shaft. The backup pad is as described above. The mounting shaft includes a first end and a second end. The first end includes a groove for engagement with the drastic means. The mounting shaft also includes a mating portion defining a cross section corresponding to the opening cross section in the boss.

The present invention also provides a method of refining a surface of an object with a plurality of abrasive articles. The method comprises the steps of: a) refining the surface with a first abrasive article supported on a first backup pad, the first backup pad being releasably mounted on a power tool; b) removing the first backup pad from the power tool; c) mounting a second backup pad on the power tool, with a second abrasive article supported on the second backup pad; and d) further refining the surface with the second backup pad and second abrasive article. The first abrasive article may have a composition different from the second abrasive article. The first and second backup pads preferably are mounted to the power tool by the quick release system described above.

BRIEF DESCRIPTION OF THE DRAWINGS

The present invention will be further explained with reference to the appended FIGURES, wherein like structure is referred to by like numerals throughout the several views, and wherein.

DETAILED DESCRIPTION OF THE INVENTION

Figure 1:
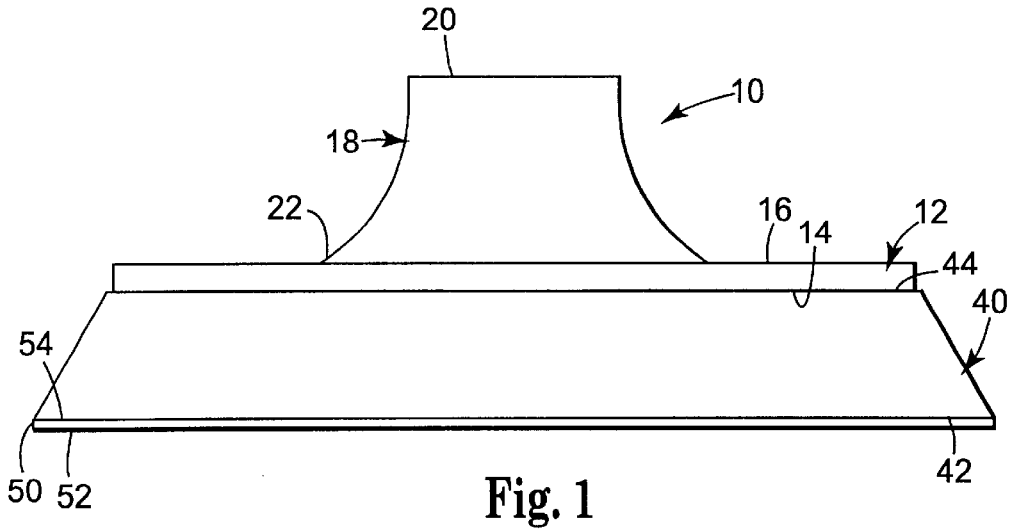
FIG. 1 is a side view of a backup pad according to the present invention.

FIG. 1 is a side view of a preferred embodiment of a backup pad 10 according to the present invention. Backup pad 10 includes a backing plate 12 having a front surface 14 and rear surface 16. A boss 18 extends from the rear surface 16 of the backing plate 12. Boss 18 includes a first end 20 remote from the backing plate 12 and a second end 22 adjacent the backing plate 12. Boss 18 is preferably unitary with the backing plate 12. Alternatively, boss 18 and backing plate 12 may be two pieces joined or bonded together.

The backup pad 10 also includes a resilient pad 40 which has a front surface 42 and a rear surface 44. The resilient pad 40 is attached at rear surface 44 to the front surface 14 of the backing plate 12. The backup pad also includes an engagement element 50 attached to the front surface 42 of the resilient pad. Engagement element 50 includes a front surface 52 for releasable engagement with an abrasive article and a rear surface 54 which is attached to the front surface of the resilient pad.

Figure 2:
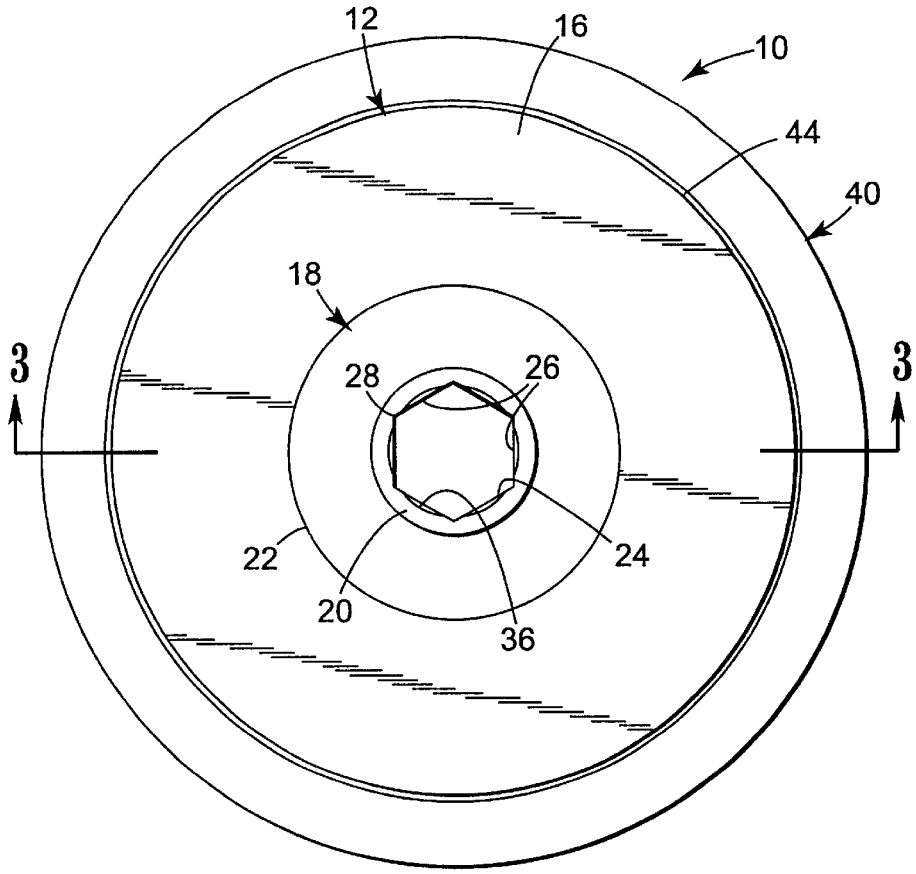
FIG. 2 is a top plan view of the backup pad of FIG. 1.
Figure 3:
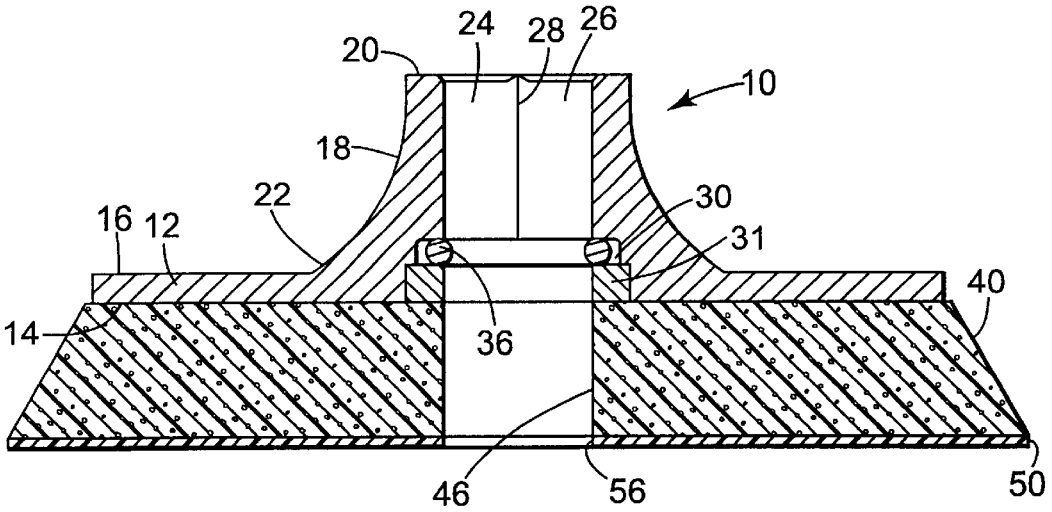
FIG. 3 is a cross sectional view of the backup pad taken along line 3—3 of FIG. 2.

As best seen in FIGS. 2 and 3, boss 18 includes an opening 24 at the first end 20. The boss opening 24 is configured for mounting on a drive shaft 70, which will be described in detail below. In the preferred illustrated embodiment, the opening 24 includes flat walls 26 which join at corners 28. In the preferred embodiment, the walls define a hexagonal cross-sectional opening 24 in the boss 18. As seen in FIG. 3, the opening also includes a groove 30 in which is retained an o-ring 36. Depending on the material of boss 18, the groove 30 may be molded or machined into the boss 18. Alternatively, a recess may be formed in the opening 24 in boss 18 which opens to the front surface 14 of the backing plate 12. Annular ring 31 may then be press fit part way into this recess thereby forming the groove 30 to retain the o-ring 36.

The backup pad 10 may optionally be configured to allow coolant or lubricant to flow through the backup pad to the surface being abraded or finished. In such a case, the resilient pad 40 includes water passage 46 aligned with the opening 24 in the boss 18, and the engagement element 50 includes a water passage 56 aligned with the pad water passage 46. The coolant flow may also be routed through passages which are directed away from the central axis.

Figure 4:
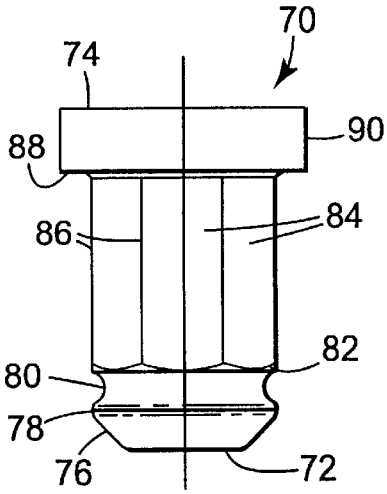
FIG. 4 is a side view of a mounting shaft suitable for use with the backup pad of FIG. 1.
Figure 5:
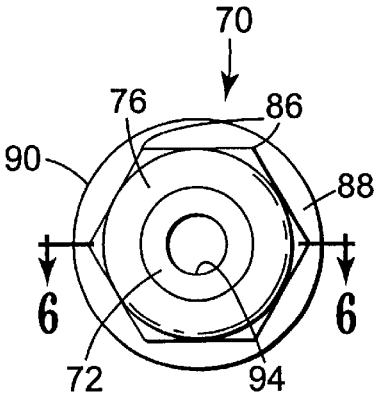
FIG. 5 is a bottom plan view of the mounting shaft of FIG. 4.

FIG. 4 illustrates a side view of a preferred embodiment of a mounting shaft 70 for use with the backup pad described herein. Mounting shaft 70 may be a separate element that can be attached to a drive shaft of conventional power tools used with the backup pad 10. Alternatively, drive shaft 70 may be a permanent element of a power tool. The mounting shaft 70 includes a first end 72 which is configured to fit into the opening 24 in boss 18 of the backup pad 10. Shaft 70 also includes second end 74 for attachment to the drive shaft of a power tool (not illustrated). Adjacent first end 72 is a tapered portion 76 to facilitate engagement of the drive shaft 70 into the opening 24 in the boss 18 and to facilitate engagement with the o-ring 36. Adjacent to and rearward from the taper 76 is a flat portion 78 which defines the bottom end of groove 80. Rearward of groove 80 is a taper 82 which transitions into flat walls 84 and corners 86 on the mounting shaft 70. The walls 84 and corners 86 are configured for close fit with the walls 26 and corners 28 of the opening in the boss on the backup pad. The walls 84 thus define a mating portion with a cross section corresponding to the cross section of opening 24 in the boss 18. The groove 80 is configured for a snap engagement with the o-ring 36 in the backup pad 10. Rearward of the flat walls 84 is shoulder 88. Shank 90 extends rearward from the shoulder 88 and terminates at second end 74 of the mounting shaft 70.

Optionally, the mating portion of the shaft 70 defined by walls 84 may be tapered so as to be smaller near the first end 72. The opening 24 in the boss of the backup pad may have a corresponding taper. With such an arrangement, the engagement between the shaft and opening is made tighter when the backup pad is under pressure during use, and also provides self-centering of the backup pad on the shaft.

Figure 6:
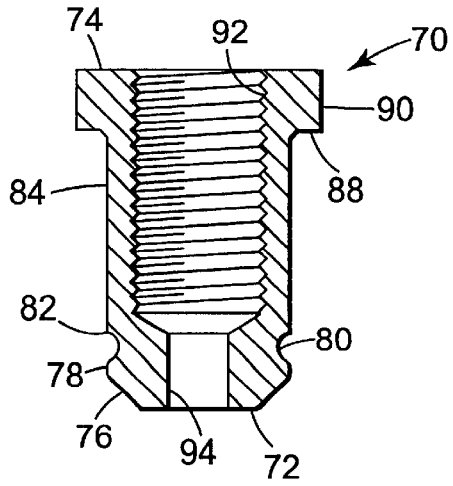
FIG. 6 is a cross sectional view taken along line 6—6 of the mounting shaft of FIG. 5.

As best seen in FIG. 6, the mounting shaft 70 includes a threaded inner diameter surface 92 for engagement with the drive shaft on the power tool. Mounting shaft 70 can optionally include water passage 94 for allowing coolant and/or lubricant to be provided through the mounting shaft 70 and the opening in the backup pad 10 onto the surface being abraded or polished.

Figure 7:
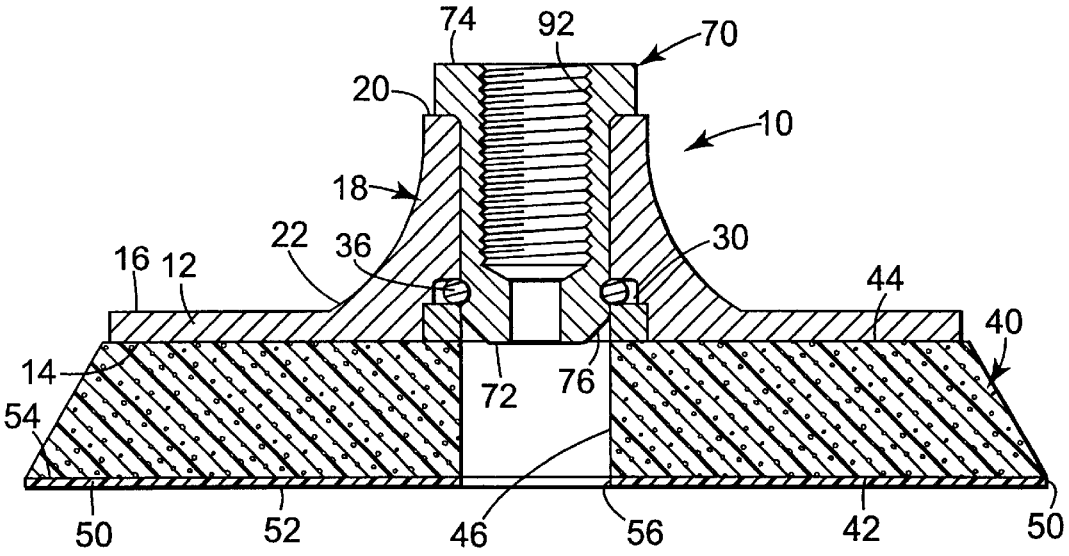
FIG. 7 is a cross sectional view of the mounting shaft engaged with the backup pad.

FIG. 7 illustrates the backup pad 10 mounted onto the drive shaft 70. The drive shaft 70 and opening 24 in the boss 18 are configured for close engagement with one another to minimize relative rotation between the backup pad 10 and the mounting shaft 70 during operation. The material and size of boss 18 and mounting shaft 70 are selected to withstand the torque imparted during use of the backup pad 10 with a power tool. Preferred materials for boss 18 include metals such as aluminum and steel, and plastics such as nylon. Preferred materials for mounting shaft 70 include metals such as steel and aluminum, graphites, and plastic.

Groove 80 engages with o-ring 36 to prevent inadvertent release of the backup pad 10 from the mounting shaft 70, while allowing the backup pad to be easily removed from the drive shaft without tools simply by pulling or pushing the backup pad 10 away with the drive shaft with enough force to overcome the snap fit between the o-ring 36 and groove 80. It is seen that the distance between the shoulder 88 and groove 80 on the drive shaft 70 can be chosen such that first end 20 of the boss 18 on the backup pad engages with the shoulder 88 on the drive shaft 70 when groove 80 is engaged with the o-ring 36. It is also seen that taper 76 on the drive shaft 70 facilitates engagement of the mounting shaft with the o-ring, and expands the o-ring as the drive shaft 70 is inserted into the opening in the boss 18. The resilient o-ring 36 then snaps back to a small diameter and engages with the groove 80 in the mounting shaft 70. The O-ring 36 may instead be any elastic member that can releasably engage with groove 80 on shaft 70, such as a snap ring, C-clip, or the like. These can be made of any suitable material such metal, rubber, vinyl, or composites selected to allow the elastic member to expand elastically without significant permanent deformation, and then contract into the groove in the shaft. It is preferred that the elastic member be retained with the groove as illustrated. The outermost wall of the groove thereby limits the expansion of the elastic member during use. This will prolong the life of the elastic member by reducing the amount of permanent stretch or growth caused during use.

The dimensions of the walls on the drive shaft 70 relative to the opening 24 in the boss 18 should be selected to minimize relative rotation between the backup pad and the drive shaft during use, while allowing easy mounting and dismounting of the backup pad from the mounting shaft 70. Arrangements for the cross-sectional shape of the mounting shaft 70 and opening 24 other than hexagonal may be chosen. Preferred arrangements include any polygonal cross-sectional shapes. For example 3, 4, or 7 or more walls may be used on the mounting shaft 70 and in the opening 24 in the boss 18. Preferably, a regular polygon is used, that is all walls are the same size, to reduce the need to index the backup pad 10 at any particular angular orientation relative to the mounting shaft 70. However, a non-regular or non-symmetrical arrangement may be used if desired. Furthermore, any non-polygonal arrangement may be used for the cross-sectional shape of the shaft and opening, except for circular, to provide an arrangement in which the backup pad does not rotate relative to the drive shaft. Therefore, what is required is that the opening 24 and the corresponding portion of the mounting shaft 70 be non-cylindrical, thereby providing a fit to prevent relative rotation between the backup pad and the shaft.

Alternative arrangements are also within the scope of the present invention. For example, although the o-ring 36 is illustrated as remaining in the opening 24 in the boss 18 on the backup pad, the o-ring 36 may instead remain in the groove 80 on the mounting shaft 70. Furthermore, the components of the mounting system may be reversed. That is, a mounting shaft 70 on the power tool may instead include a boss 18 with opening 24 configured to receive the male component of the attachment system which may be a part of the backup pad 10.

Pad 40 and backing plate 12 may be an integral, unitary element, rather than of two-piece construction as illustrated herein. Furthermore, boss 18 may be integral and unitary with plate 12, or may be a separate part joined thereto.

When present as a separate element, resilient pad 40 is preferably a resilient material such as a flexible foam, for example, polyurethane, polyester, polyester-urethane, polyether-urethane, a natural or artificial rubber such as a polybutadiene, polyisoprene, EPDM polymer, polyvinyl-chloride (PVC), polychloroprene, or styrene/butadiene copolymer. The foam can be open or closed cell. Additives, such as coupling agents, toughening agents, curing agents, antioxidants, reinforcing materials, and the like can be added to the foam formulation to achieve the desired characteristics. Dyes, pigments, fillers, anti-static agents, fire retardants, and scrim can also be added to the foam.

Particularly useful foams include TDI (toluene diisocyanate)/polyester and MDI (methylene diphenyl diisocyanate)/polyester foams. A preferred foam is a resilient, open cell polyurethane foam formed as the reaction product of a polyether polyol and an aromatic polyisocyanate. In a preferred embodiment of the aforementioned foam, the aromatic polyisocyanate includes methylene diphenyl diisocyante (MDI). Further details on this preferred foam are disclosed in WIPO International Patent Application Publication Number WO97/20662, (Keipert), the entire disclosure of which is incorporated herein by reference.

One method for forming the backup pad 10 of the present invention is to form the resilient pad 40 in situ within a mold in which the desired engagement element 50 and backing plate 12 have been placed. The engagement element 50 and backing plate 12 can be inserted in the mold either before the foam is injected into the mold or after the foam is injected but before it has completely cured. Alternately, the foam can be cured and removed from the mold, after which the desired engagement element 50 and backing plate 12 are adhered to the front and rear surfaces 42, 44 of the resilient pad 40. It is also possible to include either one of the engagement element and backing plate in the mold, and subsequently adhere the other. Conventional foam machines useful for this method of backup pad manufacture generally come in two varieties. The first type is a "low pressure" machine which relies on a mechanical mixing device in the dispensing head to mix two component streams, which when mixed, react to create the foam. A second type of foam machine is a "high pressure" or impingement mixing machine. In this type of device, mixing is achieved by impingement of two high velocity component streams within the mixing chamber. Methods of using such foam machines are known in the art.

In an alternate method for forming the resilient pad 40 of the backup pad 10, pre-fabricated foam in sheet form can be converted, that is, cut to the desired final configuration of the pad 40. The engagement element 50 and the backing plate 12 are then laminated onto the pad 40. Alternately, the engagement element 50 can be laminated onto the face of the foam sheeting with a suitable adhesive and then the laminated composite (foam and engagement element) can be converted to the desired shape.

Typically, the hardness and other physical properties of the backup pad 10 and resilient pad 40 are tailored to the desired abrading application. For example, in polishing applications it may be desired to used a softer, more flexible material for the resilient pad 40. Conversely, in more severe polishing applications, it is typically desired to use a hard, stiffer material such as a hard rubber. Since the backup pad is designed for use with power tools, the backup pad and its components should be made from materials that are capable of withstanding the intended rotational speeds. Typical speeds for a power driven rotary tool are 5,000 to 15,000 rpm, although faster and slower speeds are also used. The resilient pad 40 may alternately be selected from other rigid materials such as plastic, metal, rubber, and the like.

The engagement element 50 on the front surface 42 of the resilient pad 40 is adapted for releasably engaging abrasive articles, such as abrasive sheets. Preferred embodiments of attachment systems for engagement element 50 include mechanical fastening systems such as hook and loop systems, and adhesive systems.

Examples of hooks for use as engagement element 50 to releasably engage loop materials on abrasive sheets include mushroom hooks, "J" hooks, stalks, and "T" hooks. Commercially available hooks useful for the present invention for releasably engaging loop-backed abrasives include various hooks available from manufacturers such as Kanebo Belltouch Ltd. (of Osaka, Japan), and Velcro Inc. (of Manchester, N.H.). Examples of other suitable embodiments of hooks for use as engagement element 50 are disclosed in U.S. Pat. No. 5,505,747, "Method of Making an Abrasive Article," (Chesley et al.), the entire disclosure of which is incorporated herein by reference.

Examples of hook-engaging materials for use as engagement element 50 to releasably engage hook-backed abrasives include loop materials commonly known as stitched loop, brushed loop, formed loop, tricot loop, and the like. Commercially available loops useful for the present invention include various loops available from manufacturers such as Kanebo Belltouch Ltd. (of Osaka, Japan), Guilford Mills (of Greensboro, N.J.), and Woodeaves, Ltd. (of Lancaster, England). A backup pad having a highly durable and preferred loop system is disclosed in commonly assigned co-pending U.S. patent application Ser. No. 08/560,491 (Sheffield et al.), filed Nov. 17, 1995, the entire disclosure of which is incorporated herein by reference. For a hook and loop attachment system, either the hook component or the loop component can be on the backup pad. Hooks adapted to releasably engage a complementary hook material, i.e., attachment systems where two hooks engage such as the system available under the trade designation of "Dual Lock" from 3M, can also be used for the backup pad of the present invention.

Adhesive systems useful as engagement element 50 include pressure sensitive adhesives. Typically, the abrasive sheet has a pre-coated layer of adhesive on the side opposite the abrasive coating. The backup pad typically includes a smooth surface such as vinyl or rubber as engagement element 50 for receiving the abrasive article. The adhesive layer on the abrasive article can be adhered to the complementary mating surface of the backup pad. The abrasive article can then be easily removed when desired. The arrangement of the adhesive and vinyl components on the abrasive article and backup pad may be reversed. One preferred PSA attachment system is the "Stikit" attachment system from 3 M. Another adhesive attachment system includes the use of an adhesive commonly known as a "feathering adhesive". With this system, the abrasive article initially has no adhesive, e.g., PSA, thereon. The feathering adhesive is applied (typically sprayed) onto either the abrasive article backing or the surface of the backup pad, or both. The abrasive article is then releasably attached to the backup pad. The preferred engagement element 50 used for both feathering adhesives and PSAs is generally a smooth nonporous surface, such as vinyl, rubber, or metal, although other surfaces are suitable. In some feathering applications, cloth mating surfaces are preferred. Examples of adhesives suitable for both a PSA or a feathering adhesive include latex crepe, rosin, acrylic polymers and copolymers (e.g., polybutylacrylate), polyacrylate ester, vinyl ethers (e.g., polyvinyl n-butyl ether), vinyl acetate adhesives, alkyd adhesives, rubber adhesives (e.g., natural rubber, synthetic rubber, chlorinated rubber), and mixtures thereof One preferred pressure sensitive adhesive is an isooctylacrylate-:acrylic acid copolymer.

The abrasive articles useful for attachment to the backup pad of the present invention are not particularly limited, although they generally will be a conformable sheet or sheet-like configuration for most applications. At least one major face of the abrasive article will have an abrasive coating thereon, or the abrasive coating, i.e., abrasive grains, can extend throughout the thickness of the article, such as in a lofty non-woven abrasive article. The abrasive articles usable in the invention include, but are not limited to, coated abrasive articles, structured abrasives, non-woven abrasives, slurry coated abrasive articles, buffing pads, and polishing pads. These articles are known in the abrasives art.

A preferred use for the back-up pad of the present invention is for glass polishing, for example, television screens, CRT screens, lenses, mirrors, and the like.

To obtain a satisfactorily polished surface, generally a first abrasive article having a first abrasive grade is used to remove nicks and large scratches in the workpiece surface. This is followed by polishing with a second abrasive article having a second abrasive grade which has a smaller average particle size than the first abrasive article. This second abrasive article removes any scratches left by the first abrasive article. When using a conventional backup pad in a polishing procedure which requires the use of two or more abrasive article grades, it is generally necessary to remove the first abrasive article from the backup pad and then attach the second abrasive article. Repeated removal and reapplication of an abrasive article the article can damage the article, such as by tearing, creasing, or shelling, thereby reducing the useful life of the abrasive article.

Additionally, an abrasive particle which might be freed from the first abrasive article may be trapped, for example, in the water passage, could then be dislodged during the second polishing step. This large abrasive particle tends to produce deep wild scratches in the workpiece surface which are unacceptable.

The back-up pad having the quick release attachment system is extremely useful in overcoming many of the shortcomings of conventional backup pads. By removing the entire backup pad and abrasive article assembly, the chance of having a large abrasive particle from the first abrasive article left at the workpiece surface is greatly reduced. Additionally, the need to remove and reapply abrasive articles to the backup pad, which may deteriorate the abrasive article, is minimized.

A preferred method of using the back-up pad of the present invention would actually be to have one grinder or power tool and two back-up pads, with a first abrasive article on one pad and a second abrasive article on the other pad. During the polishing process, the back-up pad having the first abrasive article thereon would be attached to the grinder and then polish the workpiece. Once a finish acceptable for that step has been achieved, the back-up pad would be removed from the grinder and the other back-up pad having the second abrasive article thereon would be attached. The workpiece surface would then be polished with this second abrasive article. Once a finish acceptable for that step has been achieved, the back-up pad would be removed and the workpiece subjected to a third polishing step or a new workpiece would be retrieved. If a new workpiece is to be polished next, then the first back-up pad and abrasive article can be reattached to the grinder and the process is repeated.

The backup pad is preferably adapted for use with a power tool, such as, for example, an orbital sander, random orbital sander, rotary sander, dual action sander, vibratory sander, and corner sander. The backup pad can be any shape which will adapt to the tool being used. Well known tool manufactures include Black & Decker, Ryobi, Porter Cable, DeWalt, Skil, Aro and Dynabrade. Usable shapes for backup pad 10 include circles, ellipses, rectangles (including squares), triangles, hexagons, and the like. The backup pad may optionally have holes and channels therein for collecting dust, debris, and swarf, or for transporting coolant to the polishing interface, as is well known in the art. The backup pad 10 is generally between about 2.5 cm and 30 cm in diameter (measured across the longest dimension), preferably between about 7.5 and 20 cm. The thickness of the backup pad is selected to provide the desired properties from the backup pad and is generally equal throughout the pad, although there may be some instances where a tapered or sectional backup pad may be desired. The backup pad is generally between about 0.5 cm and 10 cm thick, preferably between about 0.9 and 5 cm. The peripheral side walls or edges of the can be perpendicular or at an angle to provide a tapered pad. Backup pads larger or smaller than those just described also are within the scope of the present invention.

The present invention has now been described with reference to several embodiments thereof. The foregoing detailed description has been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A method of refining a surface of an object with a plurality of abrasive articles, comprising the steps of:

a) refining the surface with a first abrasive article supported on a first backup pad while directing a liquid through the first backup pad to the surface, the first backup pad being releasably mounted on a power tool;

b) removing the first backup pad from the power tool;

c) mounting a second backup pad on the power tool, with a second abrasive article supported on the second backup pad; and d) further refining the surface with the second backup pad and second abrasive article while directing a liquid through the second backup pad to the surface.

2. The method of claim 1, wherein the first abrasive article has a composition different from the second abrasive article.

3. The method of claim 1, wherein the first and second backup pads are mounted to the power tool by a quick release system, the quick release system comprising:

a backup pad including:

i) a body comprising a front surface and a back surface;

ii) releasable engagement means provided on said front surface for releasably engaging an abrasive article; and iii) a mounting boss provided on said rear surface, wherein said mounting boss includes a first end facing away from said body, an opening in said first end of said boss, said opening being formed by an inner surface generally perpendicular to said body and defining a non-circular cross-section, said opening including elastic means for releasably retaining a shaft in said opening; and a mounting shaft comprising a first end and a second end, said first end including a groove for engagement with said elastic means, said mounting shaft including a mating portion defining a cross section corresponding to said opening cross section in said boss.

4. The method of claim 1, wherein the liquid is a coolant.

5. The method of claim 1, wherein the liquid is a lubricant.

6. The method of claim 1, wherein the liquid is water.

* * * * *

UNITED STATES PATENT AND TRADEMARK OFFICE

CERTIFICATE OF CORRECTION

PATENT NO. : 6,371,837 B1
DATED : April 16, 2002
INVENTOR(S) : Arthur P. Luedeke It is certified that error appears in the above-identified patent and that said Letters Patent is hereby corrected as shown below:

Column 1,
Line 46, insert -- be -- following “may” and preceding “a”.
Line 64, “drastic” should read -- elastic --.

Column 4,
Line 16, insert -- as -- preceding “metal”.

Column 5,
Line 53, “used” should read -- use --.

Column 6,
Line 48, “3 m” should read -- 3M --.

Column 7,
Line 26, delete “the article” following “article” and preceding “can”.

Column 8,
Line 13, insert -- backup pad -- after “the” and preceding “can”.

Signed and Sealed this

Seventeenth Day of June, 2003

JAMES E. ROGAN
*Director of the United States Patent and Trademark Office*